US006638183B2

(12) United States Patent
Takeda

(10) Patent No.: US 6,638,183 B2
(45) Date of Patent: Oct. 28, 2003

(54) GOLF CLUB

(75) Inventor: Hitoshi Takeda, Tsubame (JP)

(73) Assignee: K.K. Endo Seisakusho (JP)

( * ) Notice: Subject to any disclaimer, the term of this patent is extended or adjusted under 35 U.S.C. 154(b) by 26 days.

(21) Appl. No.: 10/004,007

(22) Filed: Nov. 30, 2001

(65) Prior Publication Data

US 2002/0165041 A1 Nov. 7, 2002

(30) Foreign Application Priority Data

Mar. 2, 2001 (JP) ..... 2001-059135

(51) Int. Cl.[7] ..... A63B 53/04
(52) U.S. Cl. ..... 473/335; 473/349; 473/350
(58) Field of Search ..... 473/324, 334, 473/335, 336, 337, 338, 339, 349, 350, 342, 290, 291, 345, 256

(56) References Cited

U.S. PATENT DOCUMENTS 2,332,342 A * 10/1943 Reach
5,050,879 A * 9/1991 Sun
5,176,384 A * 1/1993 Sata
5,312,106 A * 5/1994 Cook
5,439,223 A 8/1995 Kobayashi
5,599,243 A * 2/1997 Kobayashi
5,613,917 A * 3/1997 Kobayashi
5,669,826 A * 9/1997 Chang
5,776,010 A 7/1998 Helmstetter et al.
5,816,936 A * 10/1998 Aizawa
5,913,735 A * 6/1999 Kenmi
5,938,540 A * 8/1999 Lu
6,015,354 A * 1/2000 Ahn
6,045,456 A * 4/2000 Best
6,086,485 A * 7/2000 Hamada
6,319,149 B1 * 11/2001 Lee
6,440,010 B1 * 8/2002 Deshmukh

FOREIGN PATENT DOCUMENTS

JP 5-285238 11/1993
JP 2838876 10/1998

* cited by examiner

*Primary Examiner*—Sebastiano Passaniti
(74) *Attorney, Agent, or Firm*—Akerman Senterfitt

(57) ABSTRACT

A golf club with a further lowered center of gravity, while retaining an excellent external appearance. A head body 2A is provided with a shaft attachment portion 5 and a recess portion 8 formed in a portion corresponding to a face 4. A face member 6 is provided in the recess portion 8. An balance weight 7 is provided in a through-hole 13 formed in a sole portion 12 of the head body 2A in the longitudinal direction. Thus, the balance weight 7 is effectively arranged in the sole portion 12 which is formed the thickest in an iron head 2 so that not only the volume of the balance weight 7 but also the weight thereof can be increased. Hence, the strength of junction can be insured without using screws and pins, keeping the external appearance from being impaired.

8 Claims, 10 Drawing Sheets

GOLF CLUB

BACKGROUND OF THE INVENTION

1. Field of the Invention

The present invention relates a golf club.

2. Description of the Related Art

One of the related art of a golf club of the invention is illustrated for example in FIG. 1 of Japanese Un-Examined patent publication number 5-285238, disclosing a golf club head in which a face member is press-fitted into a recess portion formed in a face corresponding portion of a head body, while the head body and the face member are made of different materials from each other so that a position of the center of gravity in the head can be adjusted. However, as two different materials are used in the prior art, one for a head body and the other for a face member respectively, there has thus far been a limit to the adjustment of the position of the center of gravity.

Whereas, it is well known that lowering the position of the center of gravity in a head is particularly advantageous to certain golfers who swing golf clubs at relatively low head speed. For lowering the position of the center of gravity, it is effective to combine a plurality of metals each having different specific gravity as above mentioned. Light metals such as titanium, aluminum or the like may be used mainly for a head body, while heavy metals may be used for a sole portion as a balance weight. Heretofore have been used copper alloy, stainless steel, tungsten alloy or the like for such balance weight. Among them, tungsten alloy has a larger specific gravity so that the position of the center of gravity of a head can be lowered effectively by employing the same.

However, tungsten alloy has a poor extensibility as it is generally produced through a powder sintering method. Accordingly, when joining tungsten alloy to other materials, caulking is not available unlike to copper alloy or the like, so that screws and pins are generally used to join tungsten alloy to other materials, as taught, for example, in Japanese Un-Examined patent publication number 10-211304. In that case, however, exposure of screws and pins to the external is not desirable in terms of appearance.

When attaching a balance weight, it should naturally be attached to the vicinity of a sole if lowered center of gravity is preferred. According to a conventional construction, however, a balance weight is attached to a recess that is formed from outside an iron head. For example, in golf club illustrated in FIG. 1 of Japanese Registered patent publication number 2838876, a balance weight is fixed to a recess formed on a rear face of a head body. Such conventional structure causes no problem in the case that a balance weight is small. However, if a lower position of the center of gravity is required and thus a larger balance weight eventually has to be attached, there is the likelihood that the joint strength may be decreased, depending upon an attachment position and a joint area, which is not desirable from a standpoint of a degree of freedom for design.

SUMMARY OF THE INVENTION

To eliminate the above-mentioned problems, it is, therefore, an object of the present invention to provide a golf club comprising a head with a lowered center of gravity as well as a good external appearance.

To attain such objects, there is provided, according to a first aspect of the present invention, there is provided a golf club with a face on a front and a shaft attachment portion connected with a shaft, comprising: a head body including said shaft attachment portion and a recess portion formed in a portion corresponding to said face; a face member provided in said recess portion; either a recess portion or a through-hole formed in a sole portion of said head body in a longitudinal direction; and a balance weight provided in said recess portion.

According to the construction of the first aspect, not only the volume of the balance weight but also the weight thereof can be increased.

According to a second aspect of the present invention, there is provided a golf club according to the first aspect, wherein a front portion of the balance weight is abutted against a rear face of said face member.

According to the construction of the second aspect, the balance weight can be fixedly attached to the face member by anchoring the former with the latter.

According to a third aspect of the present invention, there is provided a golf club according to the first aspect, wherein said balance weight makes up at least 35% of the total weight of said head.

According to the construction of the third aspect, the position of the center of gravity can be lowered effectively.

BRIEF DESCRIPTION OF THE DRAWINGS

Other objects, features and advantages of the invention will become apparent to those skilled in the art, from the following description of the preferred embodiments of the invention, wherein reference is made to the accompanying drawings, in which.

DESCRIPTION OF THE PREFERRED EMBODIMENTS

Figure 1:
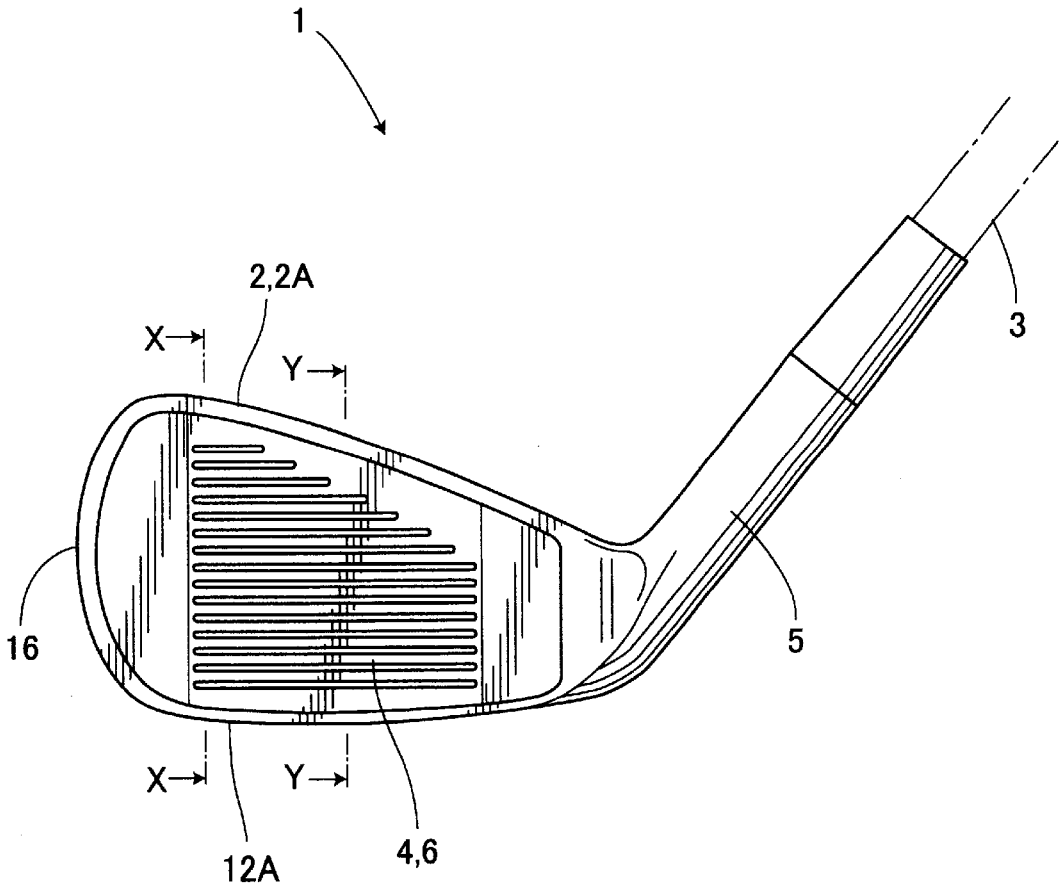
FIG. 1 is a front view of a golf club according to a first embodiment of the present invention.
Figure 2:
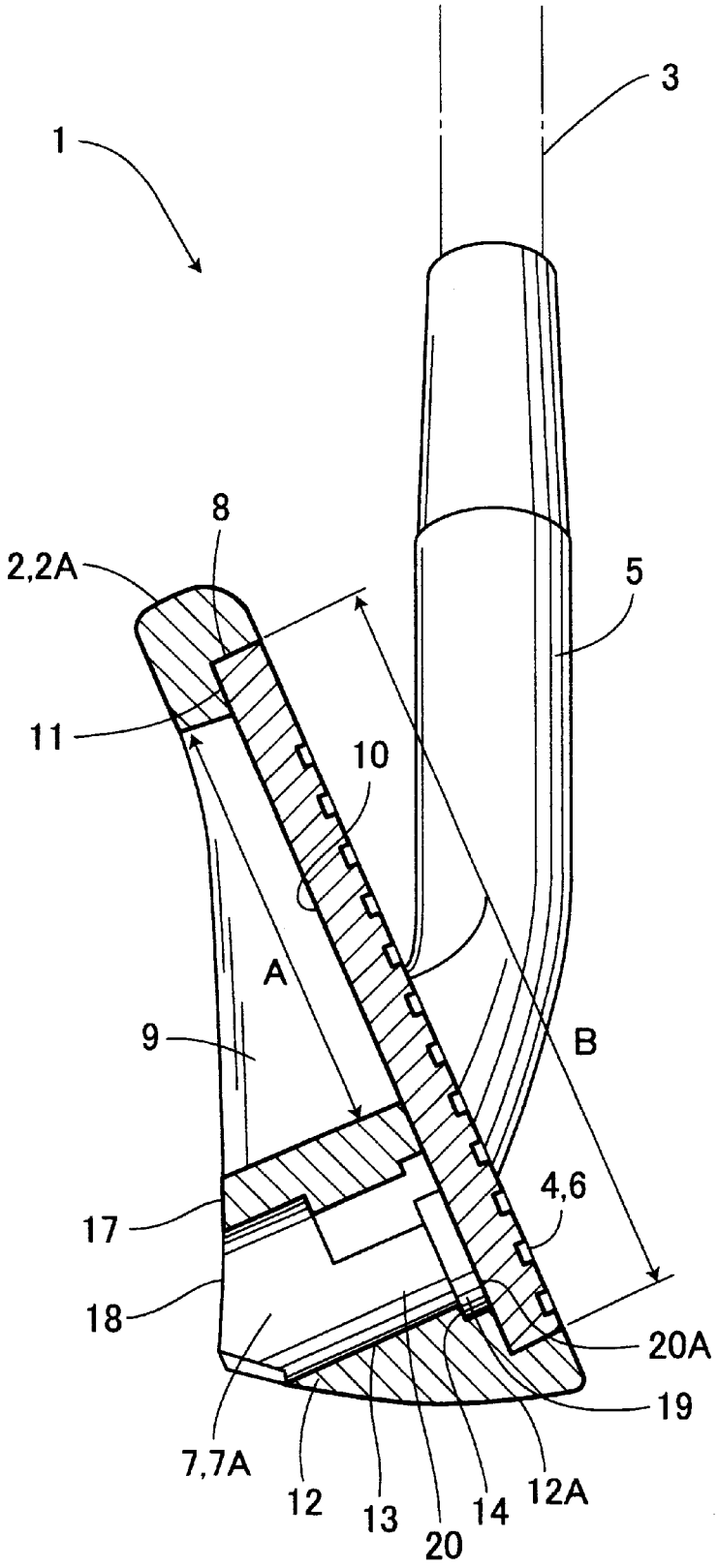
FIG. 2 is a cross-sectional view taken along line X—X of FIG. 1, illustrating the first embodiment of the present invention.
Figure 3:
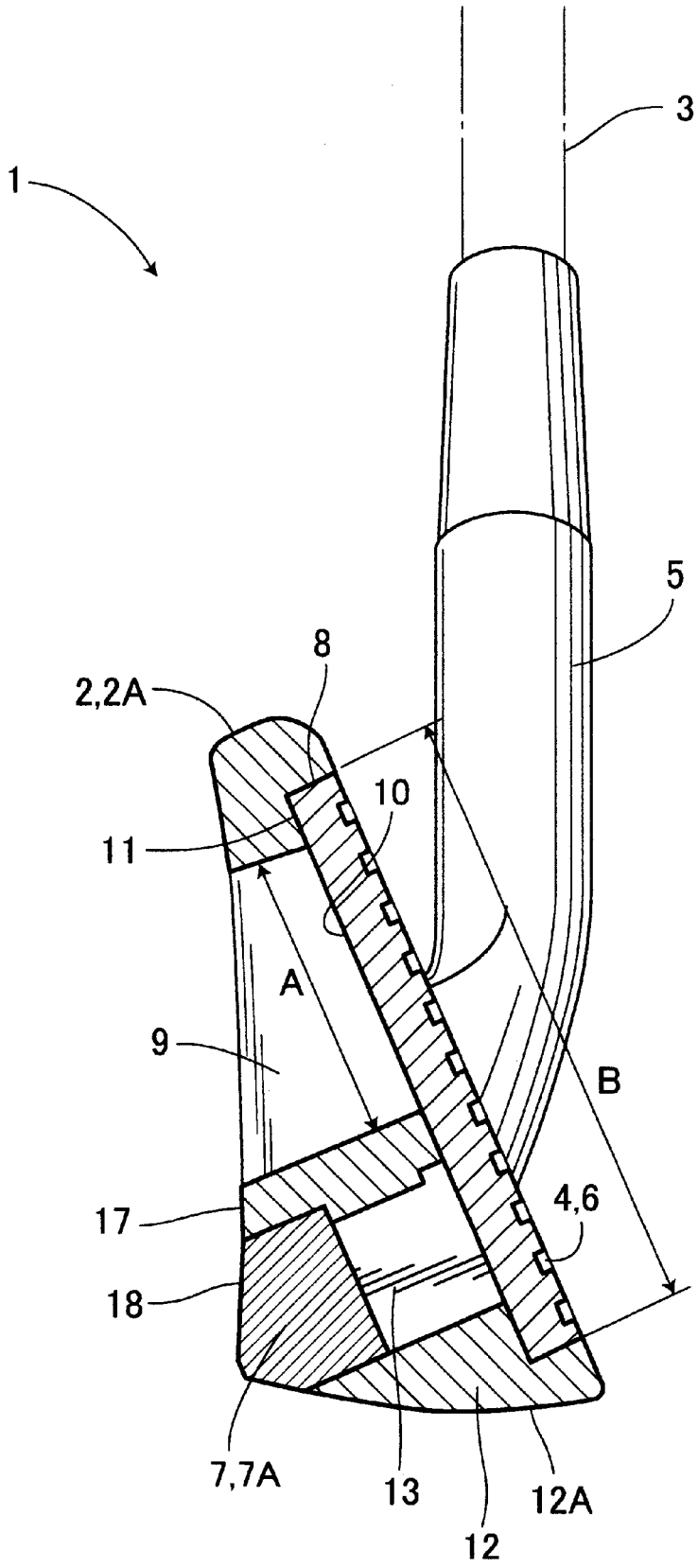
FIG. 3 is another cross-sectional view taken along line Y—Y of FIG. 1, illustrating the first embodiment of the present invention.

Hereunder is a description of embodiments of the present invention with reference to the appended drawings.

As shown in FIG. 1 to FIG. 6 showing a first embodiment of the invention, an iron golf club 1 of the embodiment comprises a head 2 and a shaft 3 connected to the head 2. The head 2 is formed with a face 4 on a front surface, serving as a ball hitting surface, while a shaft attachment portion 5 for attaching a shaft 3 to one side of the head is protruded therefrom obliquely upwardly. The head 2 comprises a head body 2A, a face member 6 and a balance weight 7. The head body 2A is formed from a pure titanium rod by hot forging, including a recess portion 8 formed in a portion corresponding to the face 4, and a through-hole 9 formed rearwardly through the upper portion of the recess portion 8, while the shaft attachment portion 5 is provided to protrude from the aforesaid one side. In the meantime, the through-hole 9 is formed so as to define an opening breadth A smaller than an opening breadth B of the recess portion 8. Said face member 6 is formed from a stamped out sheet of beta titanium alloy, having a rear face 10 thereof abutted against a bottom portion 11 of the recess 8 to be firmly fixed to the recess 8 by caulking, welding or the like.

Figure 4:
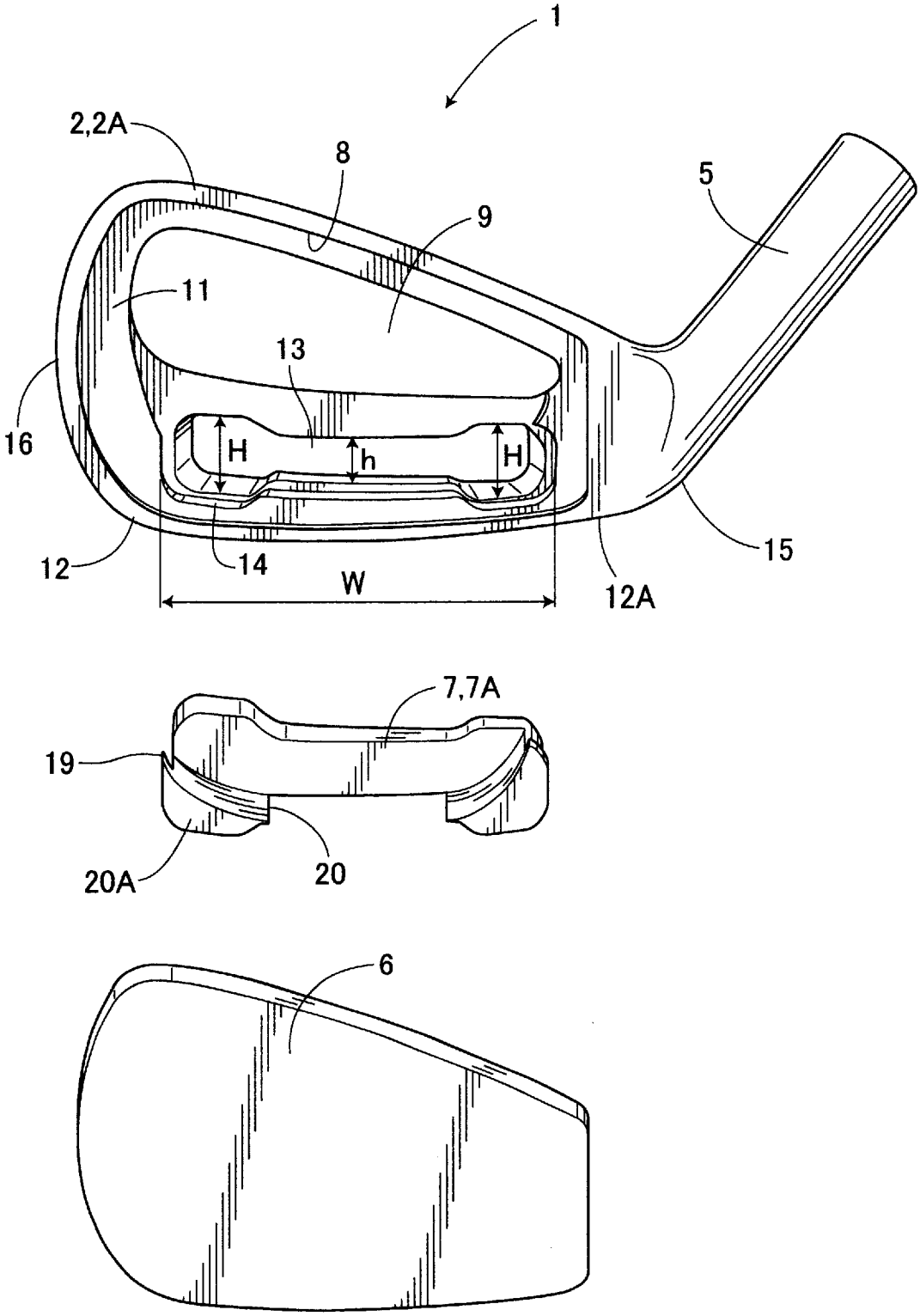
FIG. 4 is an exploded perspective view seen from a front side, illustrating a golf club according to the first embodiment of the present invention.
Figure 5:
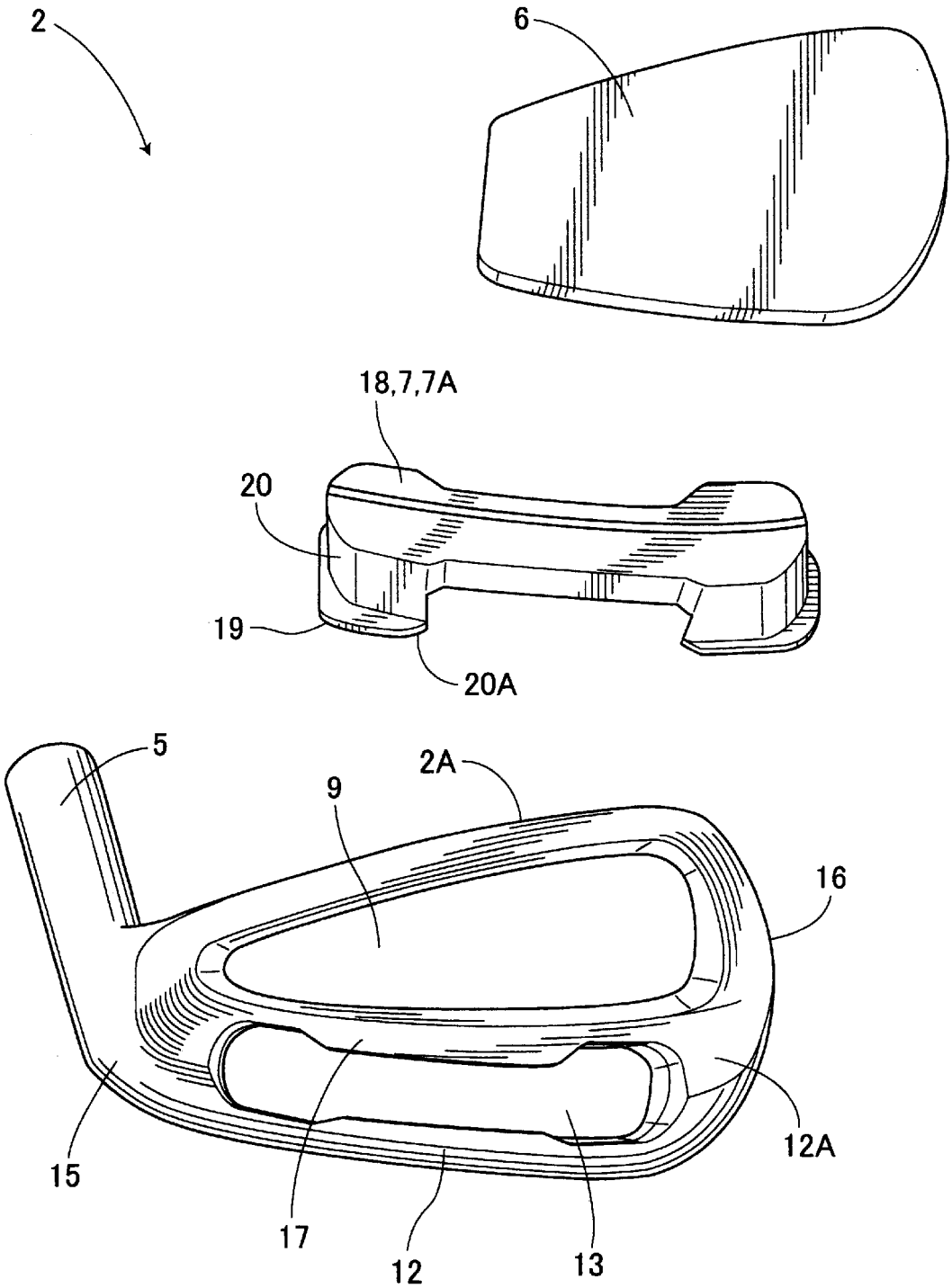
FIG. 5 is an exploded perspective view seen from a rear side, illustrating a golf club according to the first embodiment of the present invention.
Figure 6:
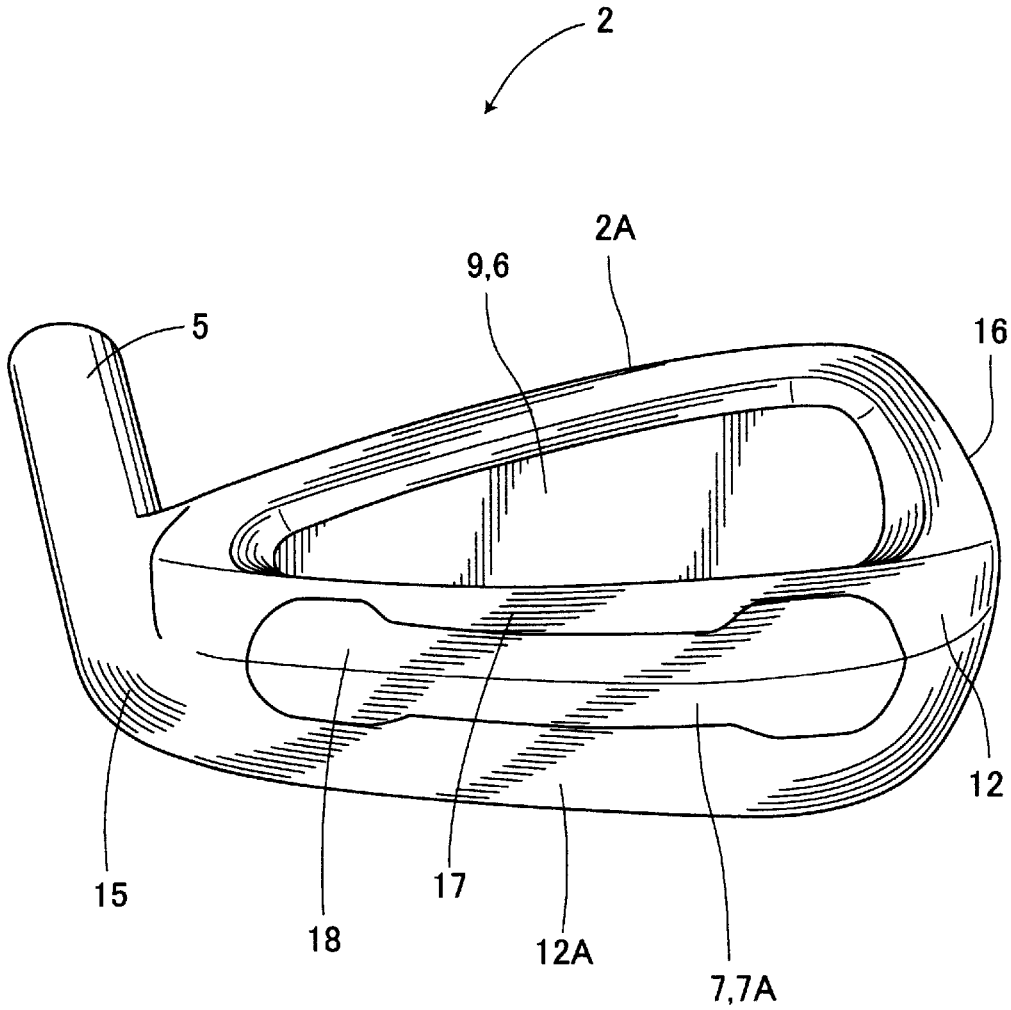
FIG. 6 is a perspective view of a rear side of a golf club head, in accordance with the first embodiment of the present invention.

The balance weight 7 is formed by powder sintering, using tungsten alloy (density: 17.5 g/cm$^3$) as a material, said balance weight 7 being fixedly inserted into a through-hole 13 formed in a sole pardon 12 which is formed thick at the bottom part of the head body, defining a sole 12A on its bottom surface. Herein, what is meant by the sole portion 12 in the present invention denotes not only the sole 12A touched by the ground but also a thickened portion in the vicinity thereof that is formed between the bottom face of the through-hole 9 and the sole 12A. The through-hole 13 is formed on the lower part of the recess portion 8 at a certain distance away from the through-hole 9, said through-hole 13 being formed transversely along the sole portion 12 of the head body 2A from the heel 15 to the toe 16. Further, the width W of the through-hole 13 is formed larger than the longitudinal length H, h thereof, said longitudinal length H defined at both sides of the through-hole 13 being longer than the longitudinal length h defined in the middle thereof. A step portion 14 is formed in the recess portion 8 by cutting away the front verge thereof at both sides of its bottom face extending from the heel 15 to the top 16 in the through-hole 13, that is, the front verge at a portion where the larger longitudinal length H is provided, as shown in FIG. 4. On the other hand, the balance weight 7 comprises: a weight body 7A with a rear face 18, said rear face 18 being flush with the rear surface 17 of the head body 2A over either side from the heel 16 through the toe 16, while closing a rear opening of the through-hole 13; and a projecting portion 20 which protrudes forward up to the bottom face 11 of the recess portion 8 at both sides of the weight body 7A, including a flange-shaped latching portion 19 to latch onto said step portion 14 at the distal end thereof.

Next is a description of the above-mentioned construction. In assembly, the balance weight 7, with the rear face 18 being directed rearward, is inserted into the through-hole 13 from the front side of the head 2A so that the rear face 18 is arranged flush with the rear face 17, while the balance weight 7 is prevented from falling out by the latching portion 19 to be latched to the step 14. Thereafter, the face member 6 is fixed to the recess portion 8 so that the rear face 10 thereof may closely contact the bottom face 11, whereby the front face 20A of each projecting portion 20 is abutted against the rear face 10 of the face member 6. As a result, the position of the center of gravity in the head 2 is shifted to a lower position by the balance weight 7.

In the meantime, the weight ratios of the balance weight to the total head weight in respective club numbers are as follows:

TABLE 1

| Club number | Head weight (g) | Balance weight (g) | Ratio (%) |
|---|---|---|---|
| 5 | 249 | 105 | 42 |
| 6 | 255 | 107 | 42 |
| 7 | 261 | 104 | 40 |
| 8 | 268 | 107 | 40 |
| 9 | 274 | 110 | 40 |
| Pitching wedge | 283 | 108 | 38 |
| Approach wedge | 283 | 108 | 38 |
| Sand wedge | 294 | 103 | 35 |

As is apparent from the above, the ratio of the balance weight to the head weight may desirably be set at 35% or above.

With the above-mentioned construction, it is possible to lower the center of gravity in a golf club head to the lowest possible point.

Figure 10:
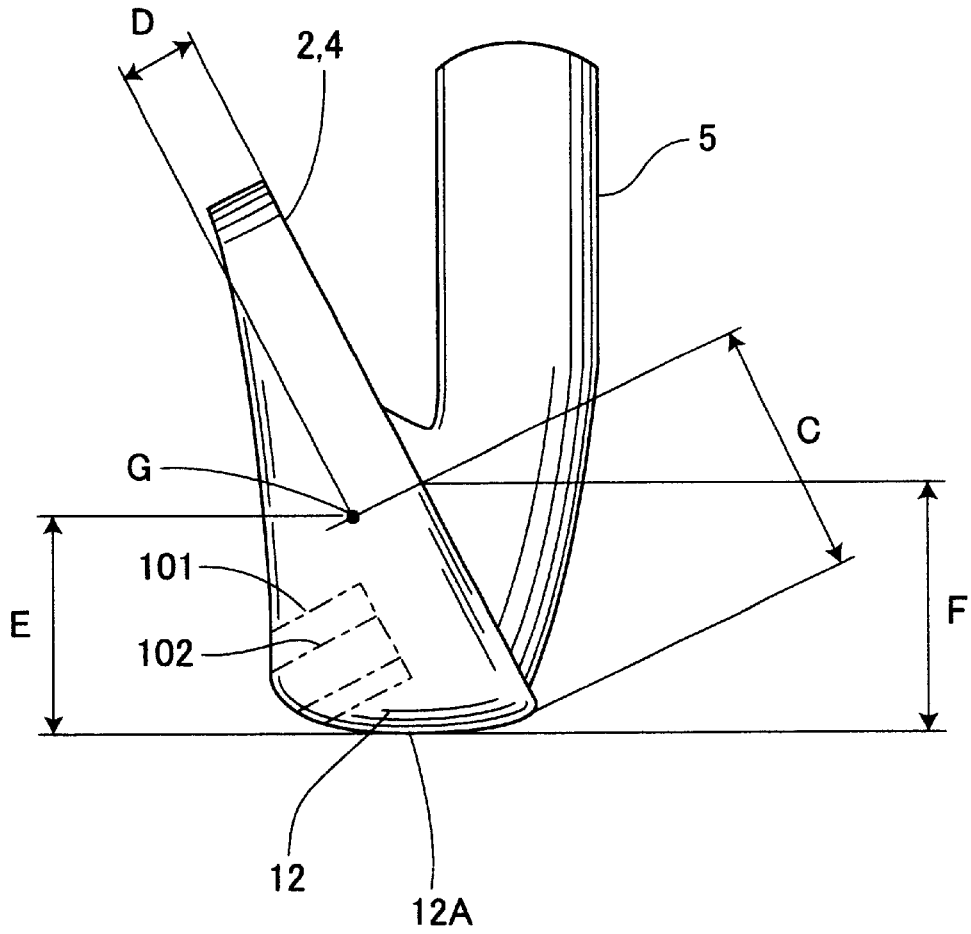
FIG. 10 is an explanatory diagram illustrating the position of the center of gravity.

Referring to FIG. 10 illustrating the position of the center of gravity G in a club head, reference symbol C denotes a distance between the lower end of the face 2 and the intersection of a normal line from the point G to the face 2 with the face 2, D a distance between the point G and the face 2, E a distance between the sole 12A and the point G, F a distance between the sole 12A and the aforesaid intersection, respectively. The following table 2 shows the result of comparison of No.5 iron club head of the embodiment with a conventional one in respect of the respective distances C to D. In the meantime, the conventional iron club head as a comparative example comprises a balance weight 101 fixed by rivets 102 as shown in chain lines in FIG. 10.

TABLE 2

| | C (mm) | D (mm) | E (mm) | F (mm) |
|---|---|---|---|---|
| An iron club head of the embodiment of the present invention | 16.27 | 8.39 | 15.94 | 19.22 |
| A conventional iron club head | 19.47 | 7.78 | 18.51 | 21.9 |

As described above, any numerical value of the golf club head according to the embodiment of the present invention serves to lower and deepen the position of the center of gravity in the head.

Thus, according to the foregoing embodiment, the head 2 comprises: the head body 2A having the recess portion 8 formed in the portion corresponding to the face 4 and the shaft attachment portion 5; the face member 6 provided in the recess portion 8; and the balance weight 7 provided in the through-hole 13 which are formed in the sole portion 12 of the head body 2A. Accordingly, the balance weight 7 is arranged effectively in the sole portion 12 that is formed the thickest in the iron type head 2 so that not only the volume of the balance weight 7 but also the weight thereof can be increased, while ensuring its joint strength without using screws nor pins, thus keeping the attractiveness of the external appearance from being impaired.

Further, as the front portion 20A of the balance weight 7 is abutted against the rear face 10 of said face member 6, the balance weight 7 can be secured simply and reliably by anchoring the balance weight 7 with the face member 6.

Moreover, due to the weight of the balance weight 7 making up at least 35% of the total weight of the head 2, weight is concentrated particularly on the sole portion 12, whereby the position of the center of gravity can be lowered effectively.

Figure 7:
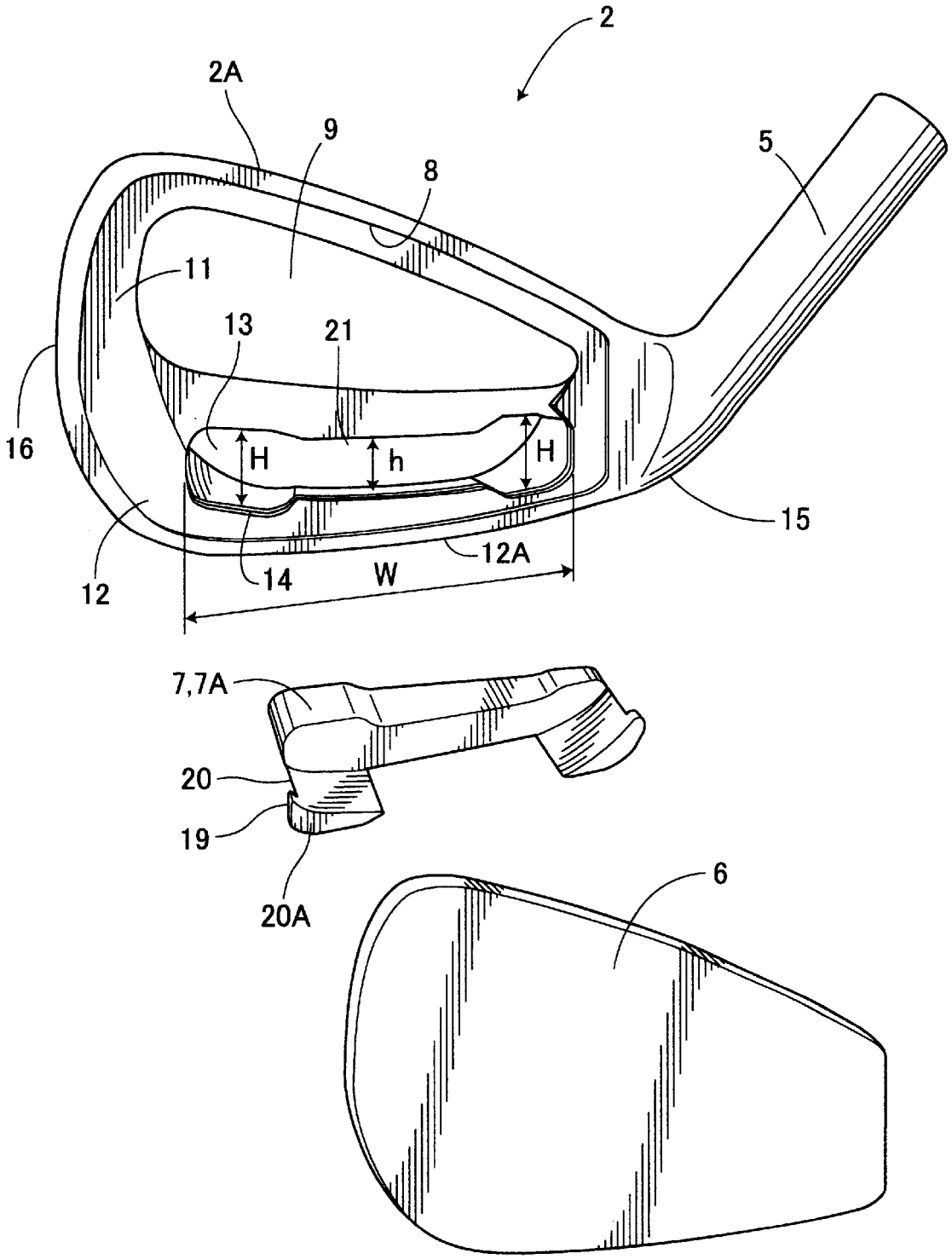
FIG. 7 is an exploded perspective view seen from a front side, illustrating a golf club according to a second embodiment of the present invention.
Figure 8:
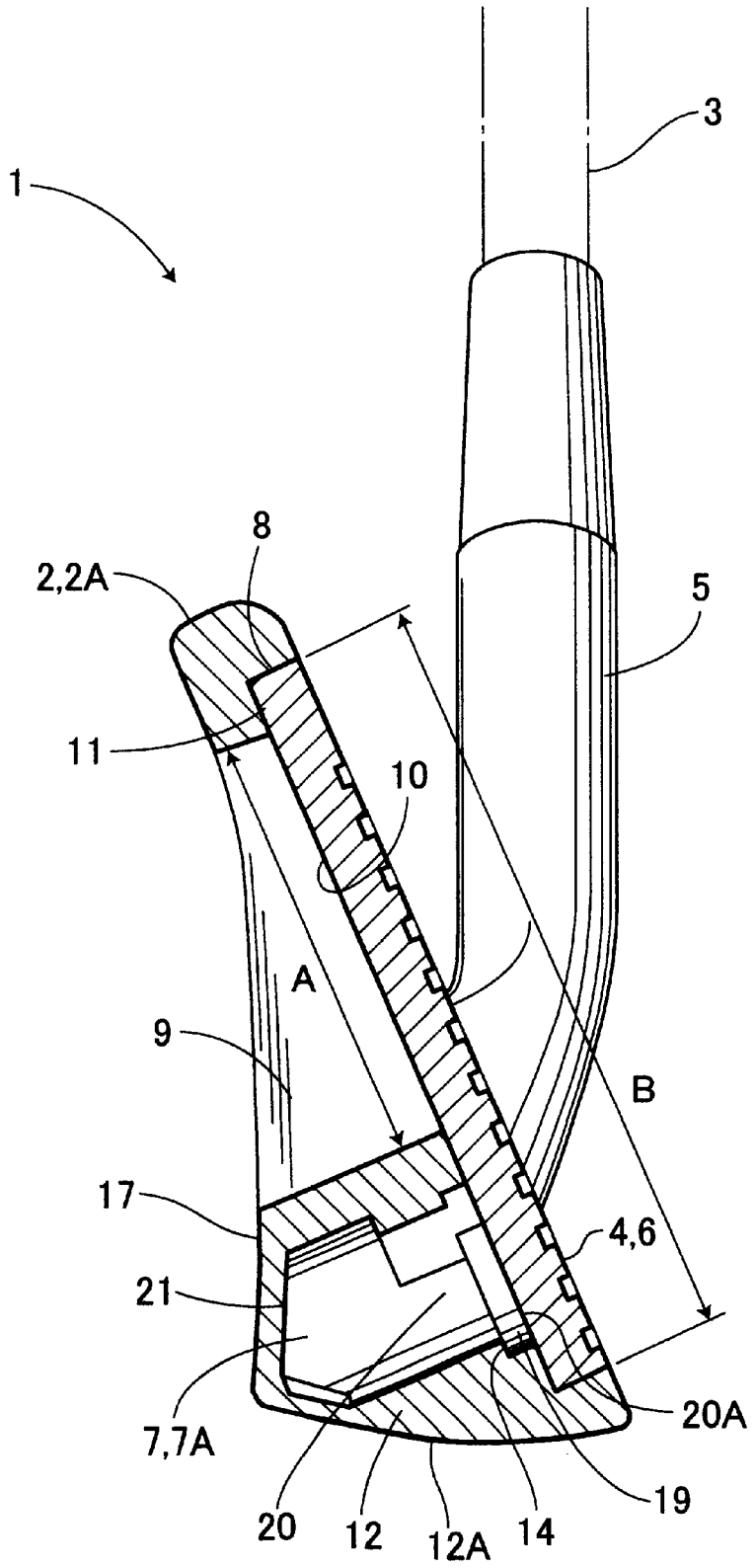
FIG. 8 is a section of a golf club according to the second embodiment of the present invention.
Figure 9:
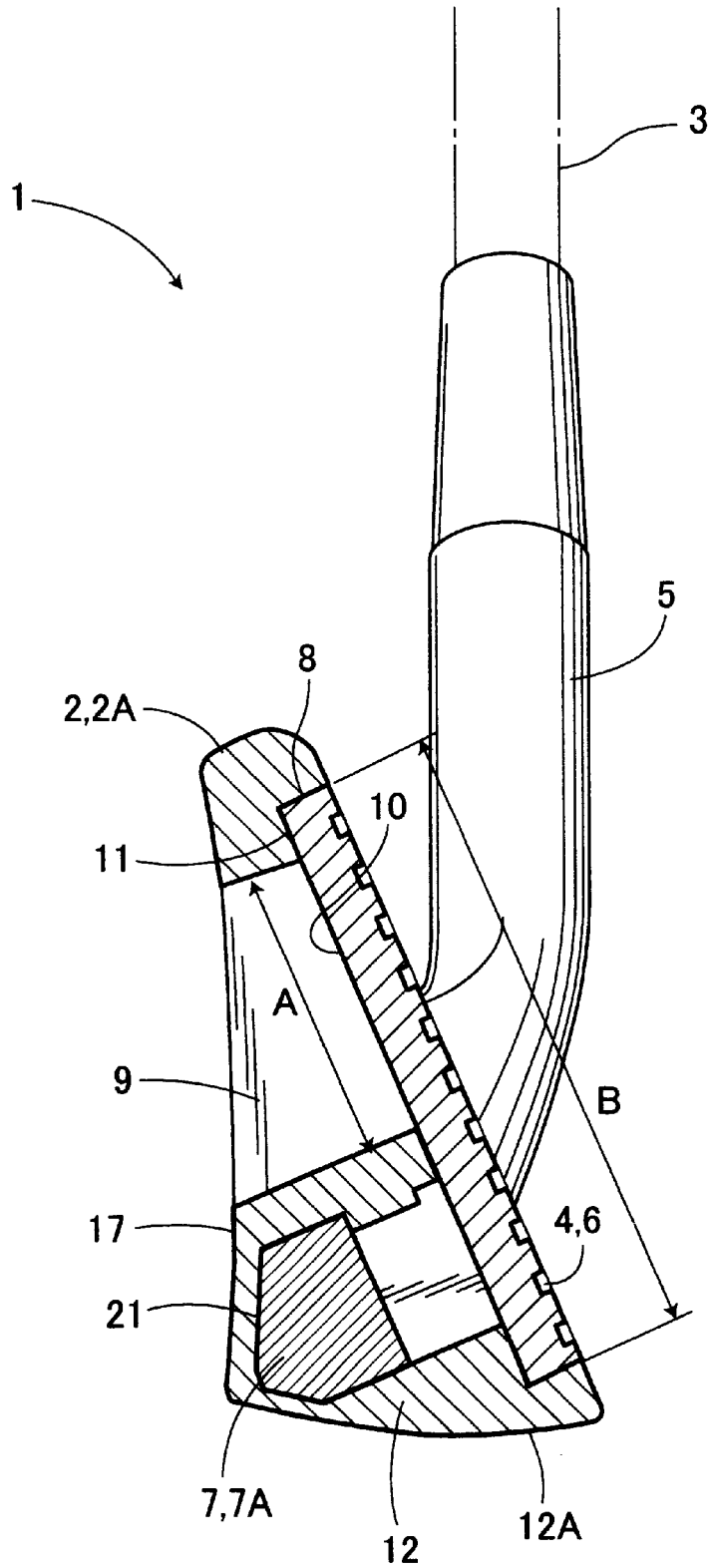
FIG. 9 is another section of other portions than shown in FIG. 8, illustrating the second embodiment of the present invention.

Referring to FIGS. 7 to 9 showing a second embodiment of the invention, the same reference numerals are used for parts the same as in the first embodiment, and their detailed descriptions are omitted.

In the second embodiment, a cavity portion 21 extending rearwardly from the recess portion 8 is formed in the sole portion 12 instead of the through-hole 13, while the balance weight 7 is inserted into the cavity portion 21 from the front side, and then the face member 6 is attached fixedly to the recess portion 8.

According to the second embodiment, the balance weight 7 is arranged effectively in the cavity portion 21 which is formed in the sole portion 12 that is the thickest portion in the head, so that the volume of the balance weight 7 can be enlarged, while keeping the appearance of the head from being impaired as the balance weight 7 is not exposed to the external.

Incidentally, the present invention should not be limited to the above embodiments, but may be modified in various manners, within the scope of the invention.

What is claimed:

1. A golf club with a face on a front and a shaft attachment portion connected with a shaft, comprising:

a head body including said shaft attachment portion and a recess portion formed in a portion corresponding to said face, said head body defining a front-to-rear ball-striking direction, and a heel-to-toe direction;

a face member provided in said recess portion;

a cavity portion formed in a sole portion of said head body in the front-to-rear direction; and a balance weight provided in said cavity portion, wherein said balance weight comprises a projecting portion which protrudes forward at both sides of said weight defined in the heel-to-toe direction, including a flanged latching portion for latching onto said recess portion with a front face of each projecting portion abutted against a rear face of the face member.

2. A golf club according to claim 1, wherein said balance weight makes up at least 35% of the total weight of said head.

3. A golf club according to claim 1, wherein said balance weight is formed larger at both sides than at a middle side in a longitudinal length.

4. A golf club according to claim 1, wherein said recess portion is formed with a step portion on its both sides defined in the heel-to-toe direction, said step portion being formed by cutting away a front verge of said recess portion so that said latching portion is allowed to latch onto said step portions.

5. A golf club with a face on a front and a shaft attachment portion connected with a shaft, comprising:

a head body including said shaft attachment portion and a recess portion formed in a portion corresponding to said face, said head body defining a front-to-rear ball-striking direction, and a heel-to-toe direction;

a face member provided in said recess portion;

a through-hole formed in a sole portion of said head body in the front-to-rear direction; and a balance weight provided in said through-hole, wherein said balance weight comprises a projecting portion which protrudes forward at both sides of the weight defined in the heel-to-toe direction, including a flanged latching portion to latch onto said recess portion with a front face of each projecting portion abutted against a rear face of the face member.

6. A golf club according to claim 5, wherein said balance weight makes up at least 35% of the total weight of said head.

7. A golf club according to claim 5, wherein said balance weight is formed larger at both sides thereof than at a middle thereof in a longitudinal length.

8. A golf club according to claim 5, wherein said recess portion is formed with a step portion on its both sides defined in the heel-to-toe direction, said step portion being formed by cutting away a front verge of said recess portion so that said latching portion is allowed to latch onto said step portions.

* * * * *

UNITED STATES PATENT AND TRADEMARK OFFICE

CERTIFICATE OF CORRECTION

PATENT NO. : 6,638,183 B2
DATED : October 28, 2003
INVENTOR(S) : Hitoshi Takeda

It is certified that error appears in the above-identified patent and that said Letters Patent is hereby corrected as shown below:

Column 3,
Line 25, replace “pardon” with -- portion --.
Line 49, replace “16 through” with -- 15 through --

Signed and Sealed this

Twenty-eighth Day of December, 2004

JON W. DUDAS
*Director of the United States Patent and Trademark Office*